United States Patent [19]

Pritulsky

[11] 4,133,595

[45] Jan. 9, 1979

[54] DOUBLE ENDED RECEPTACLE

[75] Inventor: James Pritulsky, Harrisburg, Pa.

[73] Assignee: AMP Incorporated, Harrisburg, Pa.

[21] Appl. No.: 883,621

[22] Filed: Mar. 6, 1978

[51] Int. Cl.[2] ..... H01R 9/08

[52] U.S. Cl. ..... 339/95 D

[58] Field of Search ..... 339/17 C, 95 D, 205, 339/258 R, 258 P, 275 B

[56] References Cited

U.S. PATENT DOCUMENTS

| | | | |
|---|---|---|---|
| 3,648,220 | 3/1972 | Julinot | 339/95 D |
| 3,907,392 | 9/1975 | Haag et al. | 339/258 P |

FOREIGN PATENT DOCUMENTS

| | | | |
|---|---|---|---|
| 1246078 | 8/1967 | Fed. Rep. of Germany | 339/95 D |

*Primary Examiner*—Joseph H. McGlynn
*Attorney, Agent, or Firm*—Frederick W. Raring

[57] ABSTRACT

Terminal receptacle which is receptive to a conductor at each end thereof comprises a channel-shaped member having a web and sidewalls. Openings are provided in the web and first springs extend obliquely across these openings from the web towards one of the sidewalls. Second springs extend from the upper edge of one of the sidewalls obliquely towards the other sidewall and towards the web. Conductors are connected to the receptacle by inserting the wires between the free ends of the springs and the adjacent sidewalls. Overstress-prevention ears extend inward from one of the sidewalls between the springs to prevent overstressing of the springs.

13 Claims, 4 Drawing Figures

DOUBLE ENDED RECEPTACLE

BACKGROUND OF THE INVENTION

This invention relates to stamped and formed terminal receptacles which are adapted to receive one or more conductors at each end thereof. The herein disclosed embodiment of the invention is specifically intended for mounting on a circuit board however, other possible uses for receptacles in accordance with the principles of the invention will be apparent from the following description.

A wide variety of terminal receptacles or commoning blocks, which are adapted to receive two or more wires are commercially available. Most of the commercially available commoning devices comprise an insulating housing, or support, in which the conductive receptacle means are mounted and many of the commercially available devices are capable of receiving conductors extending from only one direction or at one end of the receptacle.

Under some circumstances, there is a requirement for a terminal receptacle which is capable of being mounted on a circuit board and which is capable of receiving and establishing electrical contact with a conductor on either side of the board. For example, when a smoke detector system is being installed in a building under construction, it is common building practice to place the wiring for a detector system in the walls prior to installation of the detector units on the walls. Since it can not be predicted at the time of manufacture of the detector unit precisely what the orientation of the unit will be relative to the wire when the unit is installed, it is desirable to design the detector unit such that wires can be connected to it by inserting the wires through at least two oppositely facing surfaces. The detector unit will usually contain a circuit board within the housing and the receptacle means for the wires is commonly mounted on this circuit board.

The instant invention is directed to the achievement of a double-ended receptacle device which can be mounted on a circuit board in a manner such that wires extending to either side of the circuit board can be connected to the receptacle. Terminal receptacles in accordance with the invention can be used, for example, on the circuit boards of smoke detector units as described above and under similar circumstances.

A terminal receptacle, in accordance with the invention, comprises a channel-shaped member having a web and first and second sidewalls extending from the web. First springs are struck from the web leaving openings in the web and these first springs extend obliquely across these openings and towards the second sidewall with the free ends of these springs adjacent to the second sidewall. A conductor can be connected to the receptacle by inserting the conductor through an opening in the web and locating its end between the second sidewall and the free end of one of the first springs. Second springs extend from the upper free edge of the second sidewall obliquely towards the first sidewall and towards the web. A conductor extending towards the upper free ends of the sidewalls can therefore be connected to the receptacle by inserting the end of the conductor between the free end of one of the second springs and the surface of the first sidewall. Advantageously overstress prevention ears are provided which prevent overstressing of the contact springs as a result of abusive or careless use and suitable mounting tabs may be provided on the web to mount the receptacle on a circuit board.

It is accordingly the object of the invention to provide an improved double-ended receptacle. A further object is to provide a one-piece double ended receptacle which can be manufactured in continuous strip form. A further object is to provide a receptacle which is suitable for mounting on a circuit board or the like, and is receptive to conductors on both sides of the circuit board.

These and other objects of the invention are achieved in a preferred embodiment thereof, which is previously described in the foregoing Abstract, which is described in detail below, and which is shown in the accompanying drawing in which.

Figure 2:
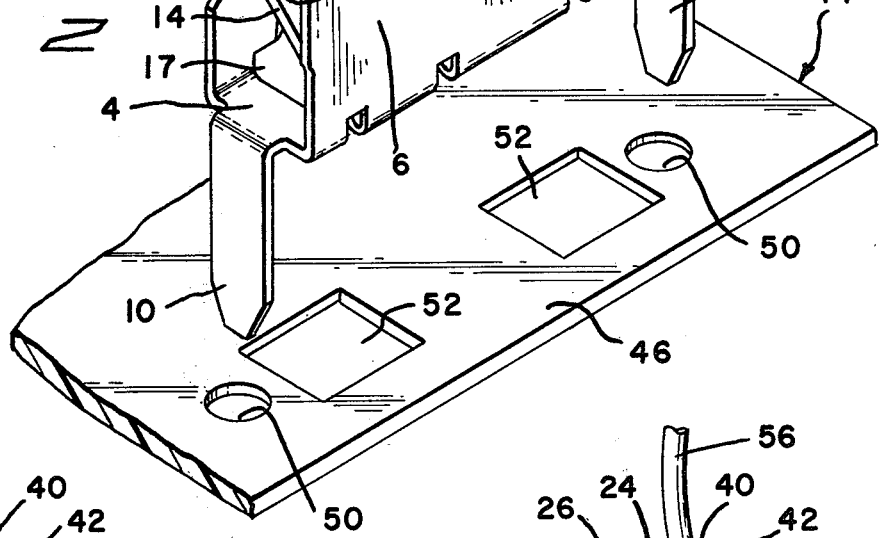
FIG. 2 is a perspective view of a receptacle terminal showing a portion of a circuit board.

Receptacle terminals 2, in accordance with the invention, are produced as a continuous strip 3 of individual receptacles in axial alignment with each other and connected to each other by carrier strip means, as described below. Each receptacle terminal 2 is a generally channel-shaped stamped and formed member having a web 4 and first and second sidewalls 6, 8 respectively. Tabs 10, 12 extend downwardly, as viewed in FIG. 2, from the ends of the web 4 to permit the receptacle to be mounted in a circuit board as shown in FIG. 3.

Electrical contact is established with the ends of wires 56, 58 by means of first contact springs 14 and second contact springs 24, the first contact springs being formed from the web 4 and extending obliquely away from the web and towards the internal surface of the second sidewall 8 so that the free ends 18 of these springs are adjacent to the second sidewall. The downwardly facing (as viewed in FIG. 3) surface of each of the spring tabs 14 is provided with a conical recess 20 and adjacent portions of the sidewall 8 are also conically formed as shown at 22, these recesses being in alignment with each other and providing a guiding surface for the wire 58 and also serving to increase the contact area between the stripped end of the wire and the receptacle after insertion.

Figure 3:
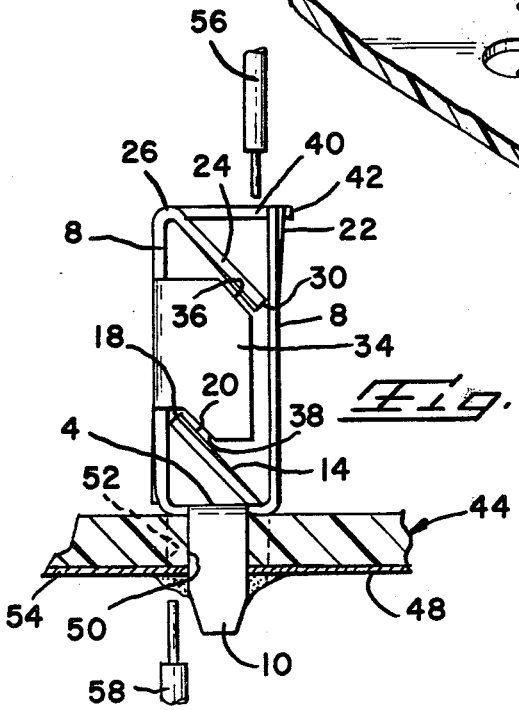
FIG. 3 is a sectional side view showing receptacle terminal mounted in a circuit board.
Figure 4:
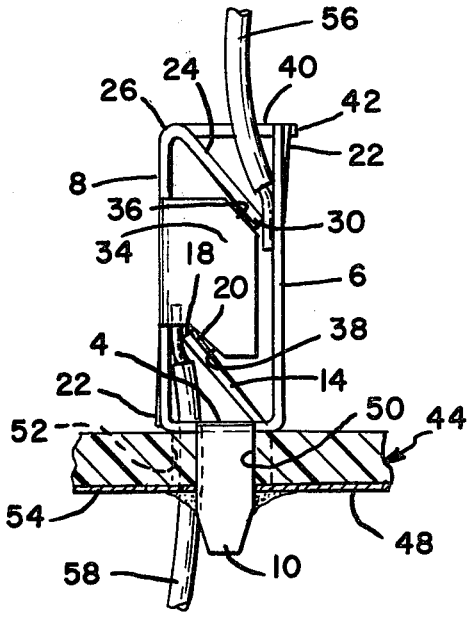
FIG. 4 is a view similar to FIG. 3 but showing the conductor as inserted into the receptacle.

Wires 56 which extend downwardly, as viewed in FIG. 3, towards the receptacle are contacted by second contact springs 24, each of which is connected by a fold 26 to the upper free edge 28 of the second sidewall 8. Each of the springs 24 extends obliquely downwardly towards the internal surface of the first sidewall 6 and towards the web 4 so that the free end 30 of each spring 24 is adjacent to the sidewall 6. The spring 24 and the adjacent portions of the sidewall 6 are provided with conical recesses 20, 22, as previously described.

It will be apparent from FIG. 3 that when the wire 58 is inserted through the opening 17 in the web the springs 14 will be flexed in a clockwise direction and the spring 24 will also be flexed in a clockwise direction when the wire 56 is inserted. It is desirable to provide an overstress prevention means for each pair of opposed springs 14, 24 in the form of an ear 34 which extends inwardly from the side edge of the sidewall 8 at a location between the two springs. This ear has an edge portion 38 which is normally spaced from, and extends parallel to, the spring 14 so that in the event of insertion of an oversized conductor, this edge will act as a stop for the ear. An edge 36 is provided adjacent to the contact spring 24 which serves the same purpose for the spring 24. It will be understood that an ear 34 is provided at each end of the receptacle so that both pairs of springs have associated overstress prevention means.

The receptacle is strengthened and rigidified by a locking ear 40 which extends laterally from the edge 28 of the sidewall 8 towards the first sidewall 6 and is latched to the upper edge of this first sidewall by an enlarged end portion 42 and a complementary notch in the upper edge of the first sidewall 6.

Figure 1:
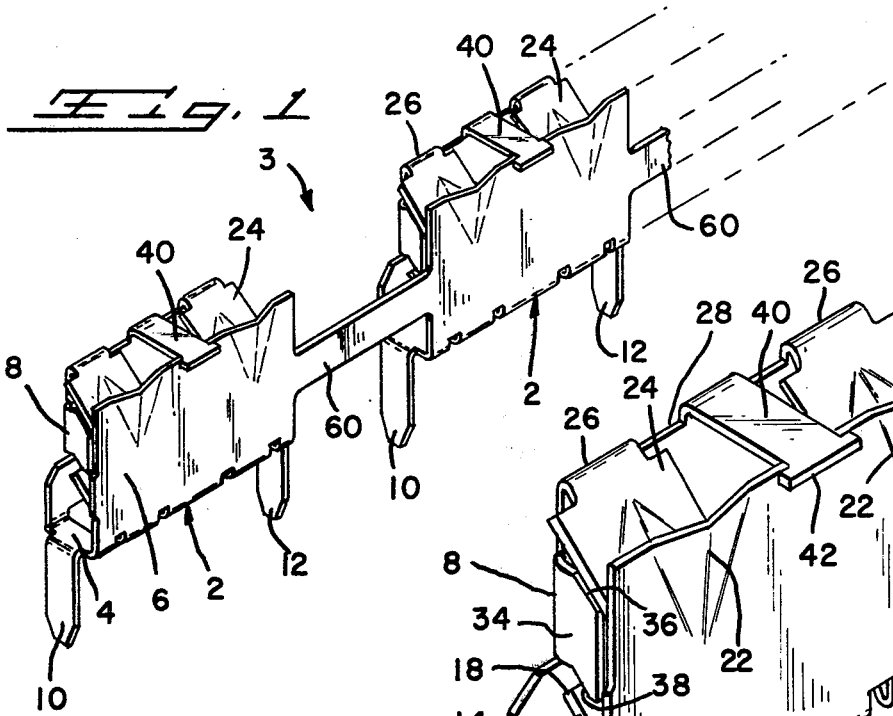
FIG. 1 is a perspective view of a section of receptacle strip in accordance with the invention.

As shown in FIG. 1, receptacle terminals are advantageously manufactured as a continuous strip with adjacent terminals being connected to each other by connecting carrier strip sections 60. The individual receptacles can thus be inserted to circuit boards with the aid of insertion machines which have tooling for severing the leading receptacle from the strip and inserting it to an aligned opening 50 in a circuit board 44. The circuit boards are provided with square openings 52 which are in alignment with the openings 17 after insertion. Where circuitry, as shown at 54, is provided on the underside 48 of the circuit board, the tabs 10, 12 can be used as solder tabs to effect the electrical connection of the receptacle to the conductors on the circuit board. Alternatively, and where the receptacle is simply being used as a commoning block, these tabs can be simply clinched to the circuit board.

It will be apparent from the drawing and from the foregoing description that the individual receptacles are extremely rigid and durable in that the contact springs or tabs 14, 24 are protected against overstressing by the ears 34 and the structural frame, the channel member, is extremely strong by virtue of the provision of the locking ear 40. The finished receptacle terminal is in effect an extremely rigid frame which is resistant to abusive or careless handling by virtue of its rigid construction.

Receptacle terminals in accordance with the invention can be produced in varying sizes of many different materials. A suitable low cost spring material is a conventional 70-30 in a spring temper. Connecting devices in accordance with the invention may be as small as 0.046 inch in length having a width of 0.0125 inch so that they are entirely suitable for mounting in confined circumstances on a circuit board. If desired, a receptacle terminal, in accordance with the invention can be designed to receive more than two wires at each end and can be used as a conventional commoning member for plurality of conductors.

What is claimed is:

1. A double ended receptacle terminal which is receptive to a conductor at each end thereof, said receptacle terminal comprising:

a stamped and formed channel-shaped member having a web and first and second sidewalls extending from said web, said sidewalls having free ends which are remote from said web, said web constituting one end of said receptacle terminal and said free ends constituting the other end thereof, an opening in said web for reception of a conductor, a first integral contact spring extending from a location adjacent to said first sidewall obliquely away from said web and towards said second sidewall, said first spring having a free end which is adjacent to said second sidewall whereby upon insertion of a conductor through said opening and between said free end of said first spring and said second sidewall, said spring is flexed and establishes electrical contact with said conductor, a second integral contact spring extending from said free end of said second sidewall obliquely towards said first sidewall and towards said web, said second spring having a free end which is adjacent to said first sidewall whereby, upon insertion of a conductor between said free end of said second spring and said first sidewall, said second spring is flexed and electrical contact is established with said conductor, and overstress prevention means between said springs, said overstress prevention means comprising ear means extending between said sidewalls, said ear means having one portion which serves as a stop for said first spring and another portion which serves as a stop for said second spring upon flexure of said springs.

2. A double ended receptacle terminal as set forth in claim 1 having mounting means for mounting said terminal on a circuit board.

3. A double ended receptacle terminal as set forth in claim 1 having locking ear means extending between said free ends of said sidewalls and serving to strengthen said sidewalls.

4. A stamped and formed receptacle terminal which is intended to be mounted on one side of a circuit board and to receive, and establish electrical contact with, a conductor on either side of said circuit board, said receptacle terminal comprising:

a channel-shaped member having a web and first and second sidewalls extending from said web, means for mounting said member on said circuit board with said web against said one surface of said circuit board, an opening in said web, a first integral contact spring between said sidewalls, said first spring having a free end which is adjacent to one of said sidewalls and proximate to, but spaced from, said web, said spring being resiliently deformable upon insertion of a conductor through said opening in said web and between said one sidewall and said free end so that said inserted conductor is electrically contacted by said spring, a second integral contact spring between said sidewalls having a free end which is adjacent to one of said sidewalls and remote from said web, said second spring being resiliently deformable upon insertion of a conductor between said free end of said second spring and said one of said sidewalls whereby, upon mounting said receptacle terminal on said one surface of said circuit board with said opening in said web in alignment with an opening in said circuit board, a conductor extending towards said one side of said circuit board can be connected to said terminal by inserting said conductor between said free end of said second spring and said one sidewall, and a conductor extending towards the other side of said circuit board can be connected to said receptacle by inserting said conductor through said openings in said circuit board and said web and between said free end of said first spring and said one of said sidewalls.

5. A receptacle terminal as set forth in claim 4, said first spring comprising a tab struck from said web and extending from a location adjacent to said first sidewall obliquely away from said web and towards said second sidewall, said opening in said web having been produced when said spring was struck from said web, said second spring comprising a tab which is integral with said second sidewall at a location remote from said web, said second spring extending obliquely from said second sidewall towards said web and towards said first sidewall.

6. A receptacle terminal as set forth in claim 5 having overstress prevention means for said first and second springs, said overstress prevention means extending from one of said sidewalls between said first and second springs and having one portion which serves as a stop for said first spring upon movement of said first spring away from said web and away from said second sidewall, and said overstress prevention means having another portion which serves as a stop for said second spring upon movement of said second spring away from said first sidewall and towards said web.

7. A stamped and formed receptacle terminal which is intended to be mounted on one surface of a circuit board and to receive, and establish electrical contact with, conductors on either side of said circuit board, said receptacle terminal comprising:

a channel-shaped member having a web and sidewalls extending from said web, solder tabs extending from said web at each end thereof, said solder tabs extending in the direction opposite to the direction of said sidewalls, at least two openings in said web, each of said openings having a contact spring associated therewith, each of said contact springs comprising a tab extending from said web at a location adjacent to a first one of said sidewalls diagonally away from said web and towards the second one of said sidewalls, said springs having been formed from said web whereby said openings are produced in said web, said sidewalls having free ends which are remote from said web, at least two additional contact springs proximate to said free ends, each of said additional contact springs comprising a tab which is integral with said free end of said second sidewall and which extends from said second sidewall diagonally towards said web and towards said first sidewall whereby, upon mounting said receptacle terminal on said one surface of said circuit board with said solder tabs extending through holes in said board and with said openings in said web in alignment with openings in said circuit board, conductors extending towards said one surface can be connected to said receptacle by inserting said conductors between said first sidewall and said additional contact springs, and conductors extending towards the other side of said circuit board can be connected to said receptacle by inserting said conductors through said openings in said circuit board and said web and between said contact springs and said second sidewall.

8. A receptacle terminal as set forth in claim 7, having overstress prevention means for said contact springs, each of said overstress prevention means comprising ear means extending from at least one of said sidewalls toward the other sidewall, said ear means having portions which serve as stops for said springs and other portions which serve as stops for said additional springs.

9. A receptacle terminal as set forth in claim 8, having locking ear means extending between said sidewalls at said free ends thereof and serving to mechanically secure said sidewalls to each other at said free ends.

10. A continuous strip of double-ended receptacle terminals:

each of said receptacle terminals comprising a channel shaped member having a web and first and second sidewalls extending in one direction from said web, said sidewalls having free ends which are remote from said web, at least one wire-receiving opening in said web, a first contact spring comprising a tab extending obliquely across said opening towards said second sidewall and away from said web, said first spring having a free end which is adjacent to said second sidewall, a second contact spring extending from said free end of said second sidewall obliquely towards said web and said first sidewall, overstress prevention ear means between said springs, said overstress prevention ear means extending from one of said sidewalls towards the other sidewall and having portions which serve as stops for said springs when said first spring is flexed away from said second sidewall and said second spring is flexed away from said first sidewall, mounting means extending from said web for mounting said terminal receptacle on a circuit board, and carrier strip means connecting adjacent receptacle terminals in said strip to each other whereby, upon severing the leading terminal receptacle of said strip and mounting said leading receptacle terminal on one side of a circuit board or the like with said opening in said web in alignment with an opening in said circuit board, a conductor on said one side of said circuit board can be connected to said terminal by inserting said conductor between said free end of second spring and said first sidewall, and a conductor on the other side of said circuit board can be connected to said terminal by inserting said conductor through said openings in said circuit board and said web and between said free end of said first spring and said second sidewall.

11. A continuous strip as set forth in claim 10, said carrier strip means comprising connecting strips extending between said sidewalls of adjacent terminals of said strip.

12. A continuous strip as set forth in claim 10, said receptacles in said strip being axially aligned with corresponding sidewalls of adjacent terminal receptacles being coplanar.

13. A continuous strip as set forth in claim 12, each of said receptacle terminals of said strip having a plurality of spaced-apart openings in said web, a like plurality of first contact springs, and a like plurality of second contact springs whereby each of said receptacle terminals is adapted to receive a plurality of wires at each end thereof.

* * * * *